US006281848B1

(12) United States Patent
Nagumo et al.

(10) Patent No.: US 6,281,848 B1
(45) Date of Patent: Aug. 28, 2001

(54) ANTENNA DEVICE AND COMMUNICATION APPARATUS USING THE SAME

(75) Inventors: Shoji Nagumo, Kawasaki; Nobuhito Tsubaki, Sagamihara; Kazunari Kawahata, Machida, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/575,426

(22) Filed: May 22, 2000

(30) Foreign Application Priority Data

Jun. 25, 1999 (JP) ..... 11-179676

(51) Int. Cl.[7] ..... H01Q 1/38

(52) U.S. Cl. ..... 343/700 MS; 343/702

(58) Field of Search ..... 343/700 MS, 702, 343/846, 848, 895

(56) References Cited

U.S. PATENT DOCUMENTS 5,861,854 * 1/1999 Kawahata et al. ..... 343/700 MS
5,867,126 * 2/1999 Kawahata et al. ..... 343/700 MS
5,959,582 * 9/1999 Kawahata et al. ..... 343/700 MS
6,147,650 * 11/2000 Kawahata et al. ..... 343/700 MS

* cited by examiner

*Primary Examiner*—Tan Ho
(74) *Attorney, Agent, or Firm*—Ostrolenk, Faber, Gerb & Soffen, LLP

(57) ABSTRACT

An antenna device comprising: a feeding radiation electrode and a non-feeding radiation electrode separately disposed on a surface of a dielectric substrate; a short circuit part of the feeding radiation electrode and a short circuit part of the non-feeding radiation electrode adjacently disposed to each other on one side surface of the dielectric substrate; and an open end of the feeding radiation electrode and an open end of the non-feeding radiation electrode disposed on mutually different surface sides of the dielectric substrate other than the surface on which said short circuit parts are disposed.

31 Claims, 8 Drawing Sheets

FIG. 8
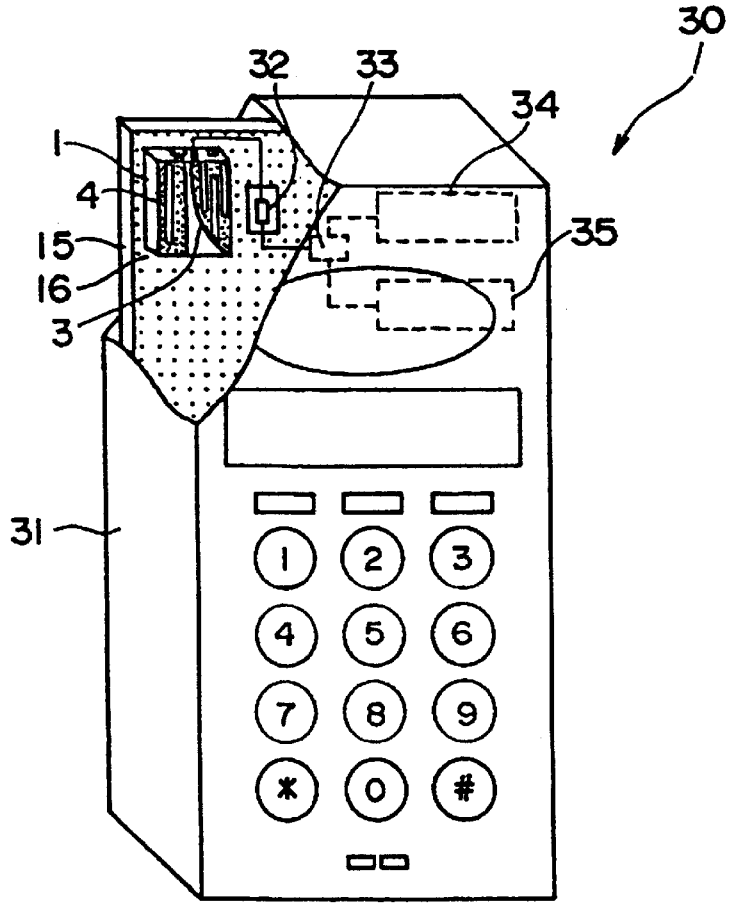
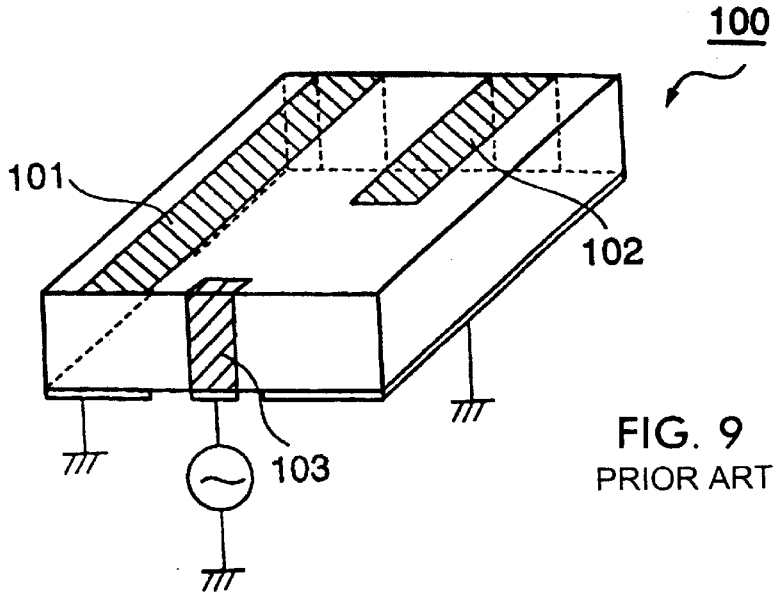
FIG. 9
PRIOR ART

ANTENNA DEVICE AND COMMUNICATION APPARATUS USING THE SAME

BACKGROUND OF THE INVENTION

1. Field of the Invention

The present invention relates to a surface-mount antenna device that allows communication in two frequency bands and a communication apparatus such as a mobile telephone that uses the same.

2. Description of the Related Art

FIG. 9 shows a conventional antenna device that is adapted to communication in two frequency bands. In FIG. 9 an antenna device 100 comprises two patch antennas 101 and 102 that have different resonant frequencies and are disposed side-by-side with a certain spacing to allow both of them to be connected to a single signal source 103 via capacitance coupling. It is thus possible to construct an antenna device that responds to two frequency bands by disposing two patch antennas with different resonant frequencies side-by-side.

However, in such type of antenna devices, too small a space between two patch antennas 101 and 102 tends to develop undesirable interference between the two patch antennas, preventing obtaining desired characteristics. It is necessary to widen the space between both of them to 3/10-wavelength or more to reduce the mutual interference between the two patch antennas to a negligible amount. This presents a problem of enlarging the size of the antenna device as a whole.

Recently, downsizing of communication apparatus such as a mobile telephone using the antenna device has been promoted and the configuration of two patch antennas disposed side-by-side will present difficulty for further promotion of downsizing of the communication apparatus. Thus, the present inventors have been engaged in developing the technology for manufacturing an antenna device in integrated circuit configuration to achieve further downsizing of the communication apparatus. In the first step of developing a surface-mount antenna device having two frequency bands, the present inventor produced a first surface-mount antenna device operating at a first frequency and a second surface-mount antenna device operating at a second frequency and tried to dispose two surface-mount antenna devices in proximity on a mounting board.

However, providing two surface-mount antenna devices reduces productivity in manufacturing the antenna device and presents a limit in achieving substantial downsizing of the communication apparatus. Also, a new problem arose in that gain is decreased if the antenna is downsized to make it of the surface-mount type. The new problem can be reduced by making the space between the antennas smaller but the smaller space between the antennas causes a problem of interference between them.

SUMMARY OF THE INVENTION

After various attempts in research and development, the present inventor has made a breakthrough by inventing a unique configuration of the antenna electrode prepared in the one-chip construction with capability to respond to two frequencies. It can reduce deterioration of gain and suppress mutual interference of signals between electrodes, even though two antenna electrode patterns are disposed in proximity on a surface of a single dielectric substrate. The present invention is made under such circumstances as above with an object of providing a high-performance small one-chip antenna device that has the above unique configuration of the antenna electrode with capability of responding to two frequencies and providing the communication apparatus using the same.

One preferred embodiment of the present invention provides an antenna device comprising a feeding radiation electrode and a non-feeding radiation electrode separately disposed on a surface of a dielectric substrate, a short circuit part of the feeding radiation electrode and a short circuit part of the non-feeding radiation electrode adjacently disposed to each other on one side surface of the dielectric substrate, an open end of the feeding radiation electrode and an open end of the non-feeding radiation electrode being disposed on mutually different surface sides of a dielectric substrate avoiding the surface on which the above-mentioned short circuit parts are formed.

In the above described antenna device, the open end of the feeding radiation electrode and the open end of the non-feeding radiation electrode may be disposed on mutually opposing surface sides of the dielectric substrate.

Furthermore, the feeding radiation electrode and the non-feeding radiation electrode may be disposed so as to cause the direction of oscillation of the feeding radiation electrode and the direction of oscillation of the non-feeding radiation electrode to cross each other in substantially perpendicular directions.

Furthermore, the dielectric substrate may be formed in a shape of a rectangular parallelepiped, either one of the feeding radiation electrode or the non-feeding radiation electrode may be disposed along an edge on the top surface of the dielectric substrate over a quadrilateral area that covers substantially the whole length of the edge, while the other electrode may be disposed within the remaining area of the top surface, the other electrode having an open end covering substantially the whole length of the other edge of the top surface opposed to the area on which the one electrode is disposed, the periphery of the one electrode adjacent to the other electrode being curved in a direction in which the distance between the periphery and the other electrode increases along the direction from one side of a width of the quadrilateral area of the one electrode to the other side.

Furthermore, at least one of the feeding radiation electrode and the non-feeding radiation electrode may be formed in a meandering shape.

Furthermore, the dielectric substrate may have a cavity or cavities inside thereof by being provided with a hole or holes inside thereof or an opening on the bottom side.

Furthermore, the dielectric substrate on which the feeding radiation electrode and the non-feeding radiation electrode are formed may be mounted on a corner portion of a mounting board having a shape of the quadrilateral and the above feeding radiation electrode and the above non-feeding radiation electrode disposed on the dielectric substrate may be disposed along the edge portion of the mounting board.

Furthermore, the mounting board may be formed in an elongated quadrilateral-shape and the non-feeding radiation electrode is disposed along an edge of the longer side of the mounting board.

Yet another preferred embodiment of the present invention provides a communication apparatus characterized by being provided with an antenna device in accordance with the invention.

According to the above structure and arrangement, since the open ends of the feeding radiation electrode and the non-feeding radiation electrode are formed on the sides of the dielectric substrate, it is possible to achieve a high degree of electromagnetic field coupling between those open ends and ground electrode (ground surface) on the mounting board, when the dielectric substrate is mounted on the mounting board. This serves to strengthen the intensity of the electric field at the open ends to allow suppressing reduction of gain in spite of downsizing the antenna by forming it on one chip.

Furthermore, since the open ends of the feeding radiation electrode and the non-feeding radiation electrode are formed on different surfaces, for example, opposite surfaces, of the dielectric substrate, the direction of oscillation of the feeding radiation electrode and that of oscillation of the non-feeding radiation electrode, represented by the directions connecting the short-circuit parts with the open ends (the directions of the resonant currents) cross in substantially perpendicular direction, or in like manner, (the directions of the surface of polarization of the radio wave radiated from the feeding radiation electrode and the surface of polarization of the radio wave radiated from the non-feeding radiation electrode assume directions crossing each other perpendicularly, or in like manner). As a result, this serves to suppress signal interference effectively between the feeding radiation electrode and the non-feeding radiation electrode, even though both electrodes are disposed adjacent to each other on a surface of a single dielectric substrate, allowing high quality communication using two frequencies.

In the present specification, each of the short circuit parts of the feeding radiation electrode and the non-feeding radiation electrode means the portion of an electrode of a conductor where the current flowing through each of the radiation electrodes is maximum.

Other features and advantages of the present invention will become apparent from the following description of the invention which refers to the accompanying drawings.

BRIEF DESCRIPTION OF THE DRAWING(S)

Figure 6A:
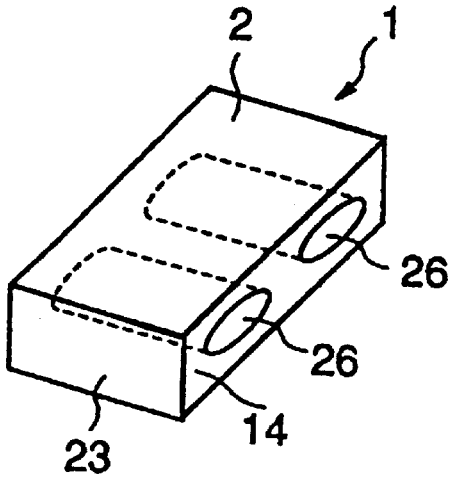
Figure 6B:
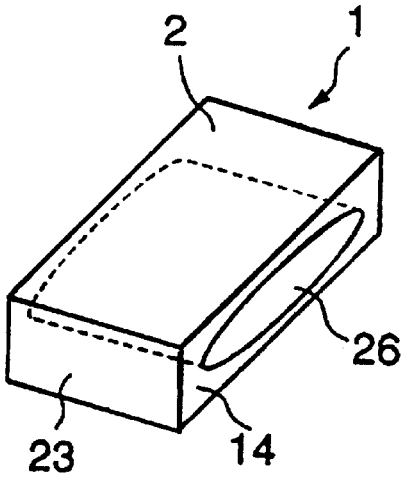
Figure 6C:
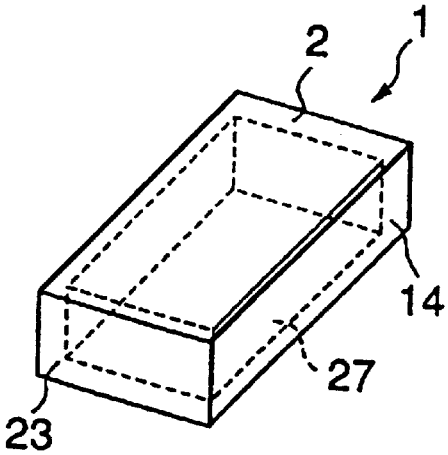

FIGS. 5*a*–5*d* illustrates embodiments of various types of antenna device with an extended area of the radiation electrode;

FIGS. 6*a*–6*c* illustrates various embodiments of the dielectric substrate in which cavity or cavities are formed;

FIG. 7 illustrates arrangements for mounting the dielectric substrate;

FIG. 8 is an illustration describing an example of usage of the antenna device (example of mounting it on a communication apparatus) of the present invention;

FIG. 9 is an illustration of a conventional antenna device.

DETAILED DESCRIPTION OF EMBODIMENTS OF THE INVENTION

Figure 1:
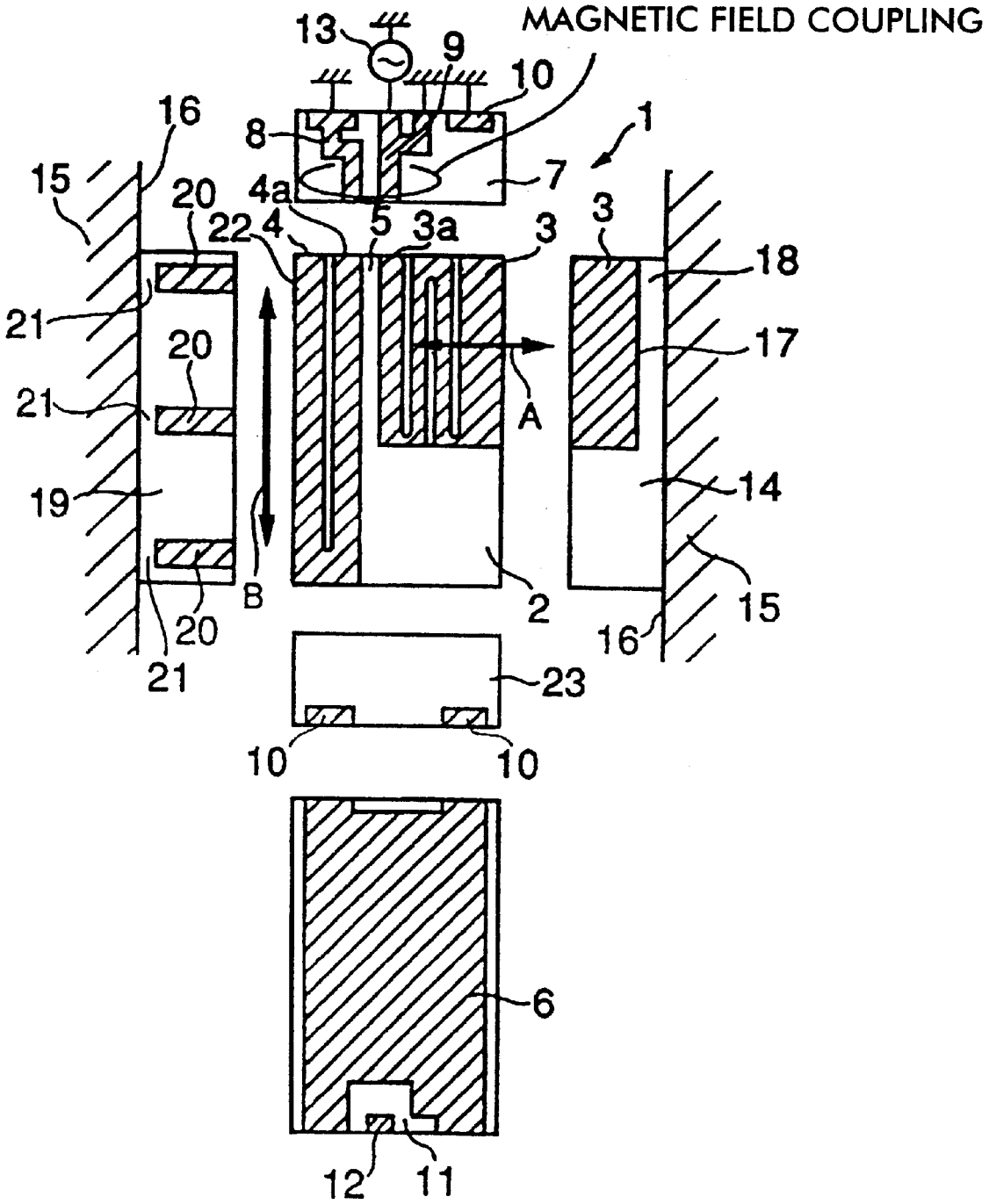
FIG. 1 is an illustration schematically describing the configuration of the first embodiment of the present invention.

FIG. 1 schematically shows the configuration of the first embodiment of the antenna device of the present invention. The 6 views in FIG. 1 schematically show the surfaces of the dielectric substrate 1 over which various electrodes are formed.

In FIG. 1 a dielectric substrate 1 is formed of such a material as ceramics, resin or the like with a high dielectric constant in the shape of a rectangular solid. On the top surface 2 of the dielectric substrate 1 are formed a feeding radiation electrode 3 and a non-feeding radiation electrode 4 in a meandering shape, respectively. The non-feeding radiation electrode 4 is formed over a quadrilateral area along a longer edge on the left-hand side of the rectangular top surface 2. The quadrilateral area extends over the whole length of the longer edge on the left-hand side of the top surface 2. The feeding radiation electrode 3 is formed over a quadrilateral area including a corner of a shorter edge on the upper right hand side of the top surface 2. The non-feeding radiation electrode 4 formed on the left hand side of the top surface 2 and the feeding radiation electrode 3 on the upper right hand side are separated by a gap 5.

On the front side surface 7 of the dielectric substrate 1 are formed electrode patterns such as a short-circuit part 8 conducting to an innermost meandering pattern 4*a* of the non-feeding radiation electrode 4 and a short-circuit part 9 conducting to an innermost meandering pattern 3*a* of the feeding radiation electrode 3 and a ground part 10. A ground electrode 6 is formed over substantially the whole of the bottom surface of the dielectric substrate 1 and the above mentioned short-circuit part 8 and ground part 10 conduct to the ground electrode 6. Also, a dielectric area 11 is formed on the bottom surface of the dielectric substrate 1 in the above ground electrode 6 to form a feeding connection electrode 12 within the dielectric area 11. The feeding connection electrode 12 conducts to the above short-circuit part 9. A signal source 13 is connected to the feeding connection electrode 12 so as to feed signal from the signal source 13 directly to the feeding radiation electrode 3.

In the present embodiment, the above short-circuit parts 8 and 9 are disposed in proximity to form electromagnetic field coupling (electromagnetic coupling) with each other, so that signals fed from the signal source 13 to the feeding radiation electrode 3 are applied to the non-feeding radiation electrode 4 via electromagnetic field coupling and both of the feeding radiation electrode 3 and the non-feeding radiation electrode 4 resonate in accordance with wavelengths of the fed signals with ¼-wavelength to perform the antenna operation. The wavelength for the antenna operation in the feeding radiation electrode 3 and that for the antenna operation in the non-feeding radiation electrode 4 are set so as to make them to be different wavelengths from each other.

The feeding radiation electrode 3 is extended onto the right side surface 14 of the dielectric substrate 1 to the mid point in the height direction. The dielectric substrate 1 is mounted on the ground surface (ground electrode) 16 of the mounting board 15, so that an open end 17 of the feeding radiation electrode 3 is capacitively coupled with the ground surface 16 to make the capacitively coupled portion of the right side surface 14 a high intensity electric field portion 18 of the feeding radiation electrode 3.

Open-end electrodes 20 conducting to the open end 22 of the non-feeding radiation electrode 4 are formed on the left side surface 19 of the dielectric substrate 1 and extend from the side of the non-feeding radiation electrode 4 downward to the ground surface 16. Spaces are provided between the lower ends of the open-end electrodes 20 and the ground surface 16 to couple them capacitively, so as to make the capacitively coupled portions of the left side surface 19 high intensity electric field portions 21 of the non-feeding radiation electrode 4. In the embodiment of FIG. 1, the open end 17 of the feeding radiation electrode 3 and the open ends (the portions designated by numerals 20 and 21) of the non-feeding radiation electrode 4 are formed on the mutually opposing side surfaces 14 and 19.

Ground parts 10 are formed adjacent to the bottom portion of the rear side surface 23 of the dielectric substrate 1. The ground parts 10 are conducted to the ground electrode 6.

The electrode configuration of the dielectric substrate 1 in the first embodiment of the antenna device is constructed as above to perform the antenna operation as follows. While the signal from the signal source 13 is directly fed to the feeding radiation electrode 3, it is also fed to the non-feeding radiation electrode 4 via electromagnetic field coupling between the short-circuit parts 8 and 9 where the intensity of the signal current is maximum. The signal current fed to the feeding radiation electrode 3 flows from the short-circuit part 9 to the open end 17 to oscillate in the direction of arrow A by resonating at a specified frequency $f_1$. On the other hand, the signal current fed to the non-feeding radiation electrode 4 flows from the short-circuit part 8 to the open ends 20 to oscillate in the direction of arrow B (which is substantially perpendicular to the direction of the arrow A) by resonating at a specified frequency $f_2$ that is different from $f_1$.

As shown above, the signal fed from the signal source 13 causes the antenna operation in the frequency $f_1$ and that in the frequency $f_2$. The direction of the current through the feeding radiation electrode 3 is similar to that of the oscillation in the direction of arrow A and the direction of the current through the non-feeding radiation electrode 4 is similar to that of the oscillation in the direction of arrow B. Accordingly, the direction of the current (resonant current) through the feeding radiation electrode 3 is substantially perpendicular to that of the current (resonant current) through the non-feeding radiation electrode 4.

According to the present embodiment, it is possible to achieve substantial downsizing of the antenna device, as the radiation electrodes 3 and 4 that perform the antenna operation in different frequencies are disposed adjacent to each other on the one-chip dielectric substrate 1. Furthermore, the dielectric substrate 1 has a high dielectric constant which is very effective in shortening the guide wavelength (the wavelength of signal propagating through the radiation electrode) of the signal. This also contributes to downsizing the antenna device.

Furthermore, as the open end 17 of the feeding radiation electrode 3 and the open-end electrodes (the open ends 20 and 22) of the non-feeding radiation electrode 4 are formed on the mutually opposing sides 14 and 19 of the dielectric substrate 1, the direction of the resonant current through the feeding radiation electrode 3 becomes perpendicular to that of the resonant current through the non-feeding radiation electrode 4. As a result, the directions of the oscillation (or, the directions of polarization) A and B of both of the radiation electrodes 3 and 4 become perpendicular. This serves to suppress interference between signals in the feeding radiation electrode 3 and that of the non-feeding radiation electrode 4, allowing high performance antenna operation, even though the feeding radiation electrode 3 and the non-feeding radiation electrode 4 are disposed adjacent to each other on the top surface of dielectric substrate 1. Especially, mutual signal interference between high intensity electric field portions of the feeding radiation electrode 3 and the non-feeding radiation electrode 4 can be prevented substantially completely by disposing the open ends of the feeding radiation electrode 3 and the non-feeding radiation electrode 4 on the opposing sides of the dielectric substrate 1.

Furthermore, since resonance of each of the radiation electrodes 3 and 4 is performed with the interference between signals in the feeding radiation electrode 3 and in the non-feeding radiation electrode 4 being suppressed, as well as the open ends 17 and 20 of each of the radiation electrodes 3 and 4 are formed so as to be electrostatically coupled with the ground surface 16 of the dielectric substrate 1, electric fields can be concentrated at the open ends 17 and 20. This enables suppression of the interference between the radiation electrodes to achieve high quality communication by holding down decrease of gain in spite of downsizing of the antenna device.

Figure 2:
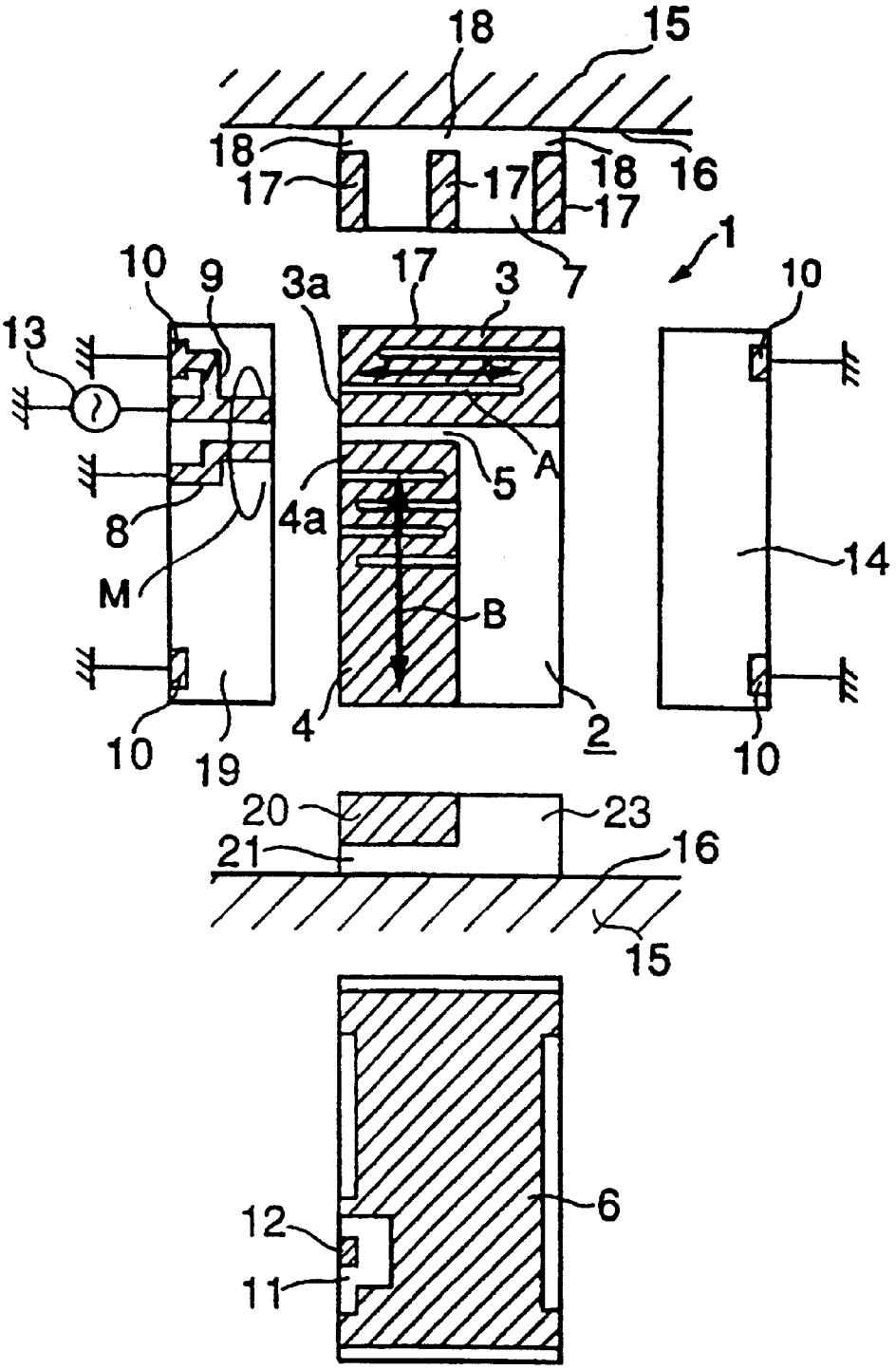
FIG. 2 is an illustration schematically describing the configuration of the second embodiment of the present invention.

FIG. 2 shows the second embodiment of the antenna device of the present invention. In the second embodiment, the feeding radiation electrode 3 is formed over a quadrilateral area along the front side of the top surface 2 of the dielectric substrate 1 (the quadrilateral area including the whole length of the upper shorter edge of the rectangle forming the top surface 2) and the non-feeding radiation electrode 4 is formed over a quadrilateral area including the lower left corner of the top surface 2. Corresponding to the above arrangement of the radiation electrodes 3 and 4, the electrodes of the open ends 17 of the feeding radiation electrode 3 are formed extending on the front side surface 7 of the dielectric substrate 1, the electrodes of the short-circuit parts 8 and 9 are formed on the left side surface 19 of the dielectric substrate 1, and the open-end electrode (the open end) 20 of the non-feeding radiation electrode 4 is formed on the rear side surface 23 of the dielectric substrate 1. Other arrangements are similar to those of the above embodiment of FIG. 1.

The second embodiment works in a similar way to the above first embodiment to provide similar effects to those of the first embodiment.

Figure 3:
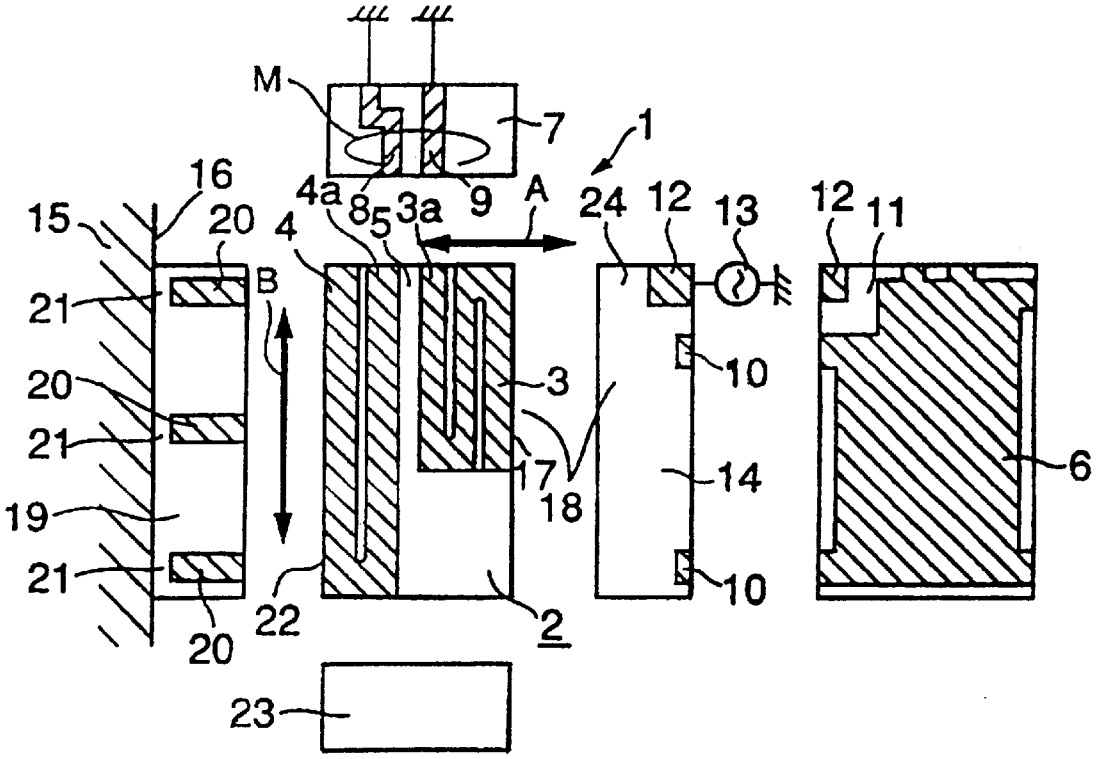
FIG. 3 is an illustration schematically describing the configuration of the third embodiment of the present invention.

FIG. 3 shows the third embodiment of the present invention. The third embodiment is characterized in that a signal is fed to the feeding radiation electrode 3 by capacitance coupling. The third embodiment has similar arrangements of the feeding radiation electrode 3 and the non-feeding radiation electrode 4 on the top surface 2 of the dielectric substrate 1 to those of the first embodiment. Also, the patterns on the top surface 2 of the dielectric substrate 1 and the left side surface 19 are similar to those shown in FIG. 1. The antenna device shown in FIG. 3 accomplishes feeding by capacitance coupling, so that a feeding coupling electrode 12 is formed on the right side surface 14 of the dielectric substrate 1, extending form the bottom side to achieve capacitance coupling between the feeding coupling electrode 12 and the feeding radiation electrode 3 via space 24 between the extended tip (the upper end) of the feeding coupling electrode 12 and the feeding radiation electrode 3.

The signal source 13 is connected to the feeding coupling electrode 12 on the right side surface 14 and both of the short-circuit parts 8 and 9 are arranged to conduct to the ground surface 16 of the mounting board 15.

In the third embodiment, the signal from the signal source 13 is fed by capacitance coupling to the feeding radiation electrode 3 via the feeding coupling electrode 12 and the resonant current of the feeding radiation electrode 3 flows in the direction of arrow A or direction connecting the open end 17 and the short-circuit part 9 in a straight line. The currents flowing through the short-circuit parts 8 and 9 become maximum and the adjacently disposed short-circuit parts 8 and 9 are coupled by electromagnetic field coupling. The signal from the signal source 13 is fed by above electromagnetic field coupling to the non-feeding radiation electrode 4. In the non-feeding radiation electrode 4 the resonant current flows in the direction of arrow B or the direction connecting the open end 22 (the open-end electrodes 20) and the short-circuit part 8 in a straight line. As described above, in the third embodiment, similar to the above first embodiment, the direction of the resonant current through the feeding radiation electrode 3 is substantially perpendicular to that of the resonant current through the non-feeding radiation electrode 4 and effects similar to those of the first embodiment are available by the operation similar to the above first embodiment.

Figure 4:
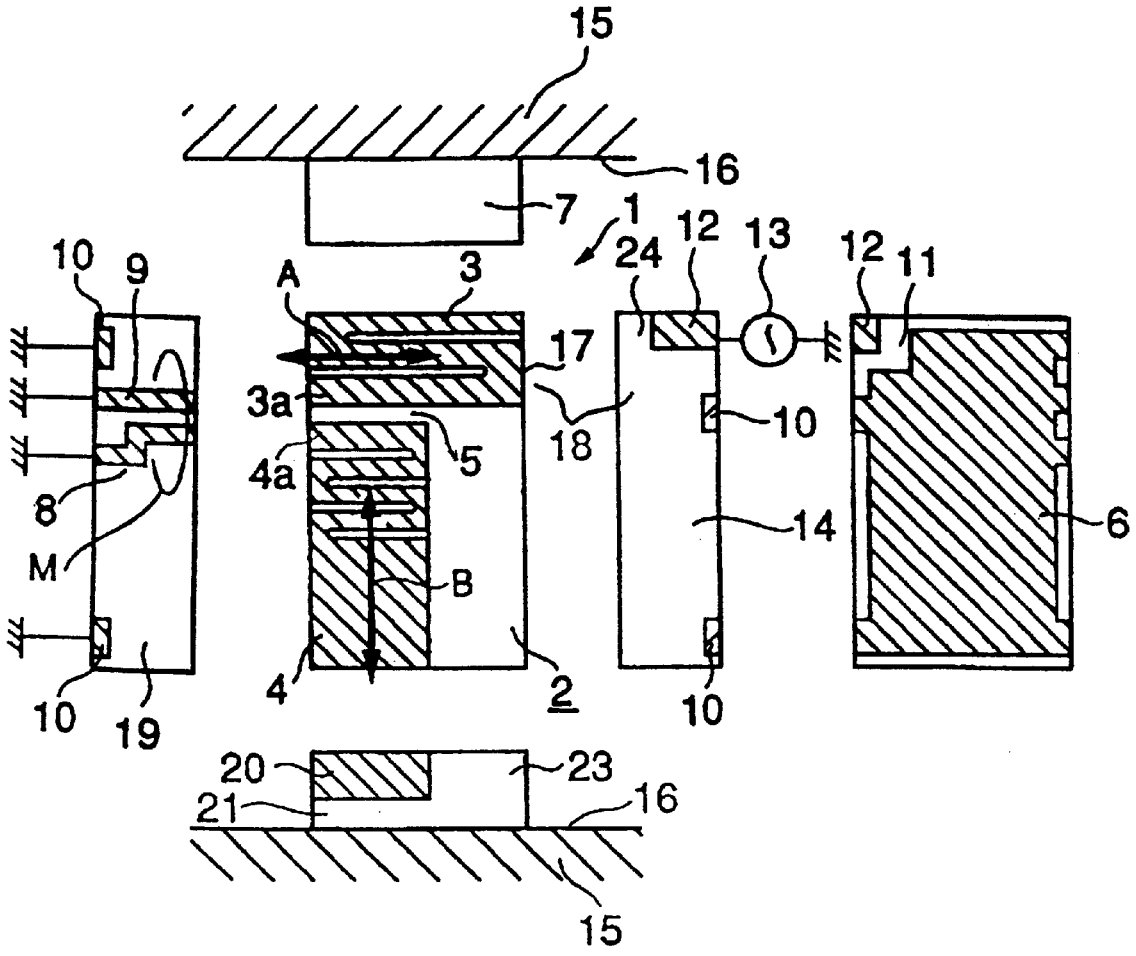
FIG. 4 is an illustration schematically describing the configuration of the fourth embodiment of the present invention.

FIG. 4 shows the fourth embodiment of the antenna device according to the present invention. Also, in this embodiment, the signal is fed to the feeding radiation electrode 3 by capacitance coupling. In this example, the device shown in the second embodiment in which signal is fed by direct excitation is modified to the capacitance coupling system. In the antenna device shown in FIG. 4, patterns on the top surface 2 of the dielectric substrate 1 and the left side surface 19 are similar to those shown in FIG. 2. To make the device shown in FIG. 4 a capacitance coupling system, the feeding coupling electrode 12 is formed extending upward on the right side surface 14 of the dielectric substrate 1, to achieve capacitance coupling between the feeding coupling electrode 12 and the feeding radiation electrode 3 via the space 24 between the extended tip (the upper end) of the feeding coupling electrode 12 and the open end 17 of the feeding radiation electrode 3.

Also, in the fourth embodiment, as the open end 17 of the feeding radiation electrode 3 is formed on the right side surface 14 of the dielectric substrate 1 and the open end (the open-end electrode 20) of the non-feeding radiation electrode 4 is formed on the rear side surface 23, the open ends of the feeding radiation electrode 3 and the non-feeding radiation electrode 4 are formed on the mutually perpendicular different sides 14 and 23. As a result, it is possible to prevent mutual signal interference between high intensity electric field portions of the feeding radiation electrode 3 and the non-feeding radiation electrode 4 substantially completely.

Also, both of the short-circuit part 8 and the short-circuit part 9 on the left side surface 19 of the dielectric substrate 1 are arranged to connect to the ground surface 16 of the mounting board 15. In the fourth embodiment, similar to the third embodiment above, a signal supplied from the signal source 13 is fed by capacitance coupling to the feeding radiation electrode 3 via the feeding coupling electrode 12 and is fed to the non-feeding radiation electrode 4 by electromagnetic field coupling between the short-circuit part 8 and the short-circuit part 9 to perform the antenna operation in a manner similar to each of the above embodiments.

In the above antenna operation, similar to each of the above embodiments, the direction of the resonant current through the feeding radiation electrode 3 (the direction A) is substantially perpendicular to that of the resonant current through the non-feeding radiation electrode 4 (the direction B), achieving similar effects by similar operation to those of each of the above embodiments.

Figure 5A:
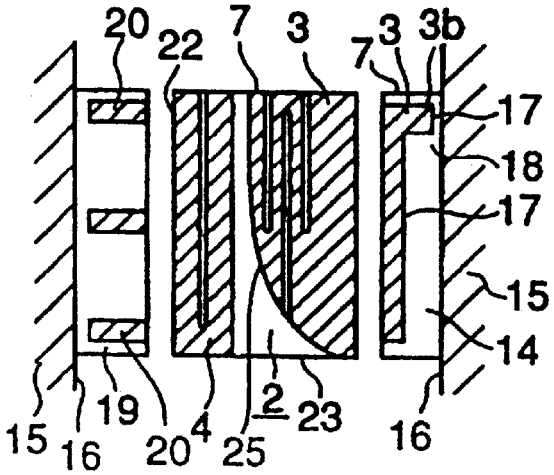
Figure 5C:
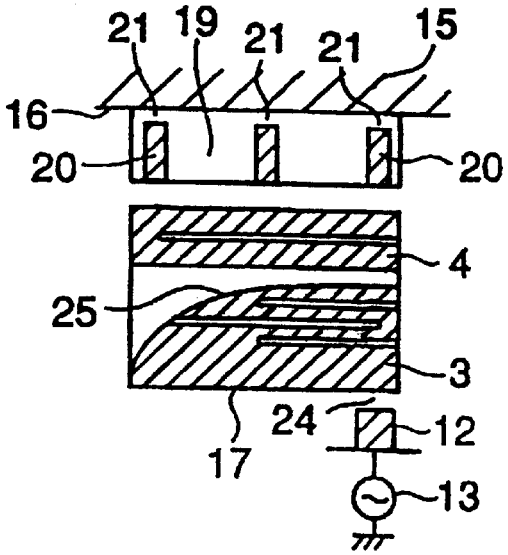
Figure 5B:
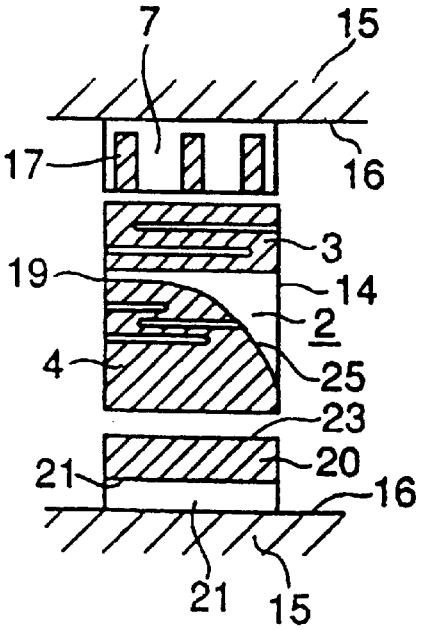
Figure 5D:
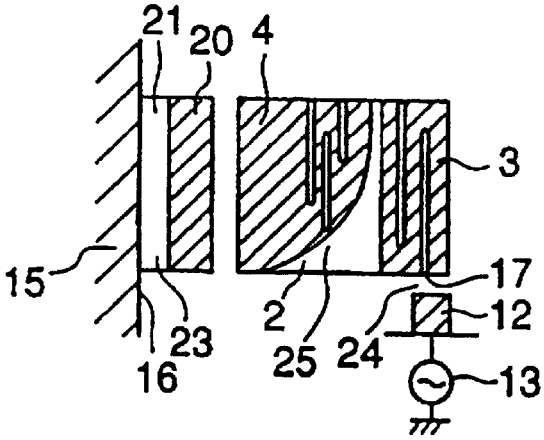

FIGS. 5A to 5D show examples of each of the above embodiments in which antenna characteristics for the antenna device are improved further. FIG. 5A shows an improved example of the device of the first embodiment (FIG. 1), FIG. 5B shows an improved example of the device of the second embodiment (FIG. 2), FIG. 5C shows an improved example of the device of the third embodiment (FIG. 3), and FIG. 5D shows an improved example of the device of the fourth embodiment (FIG. 4). Each of the improved examples shown in FIG. 5 has expanded patterns of the radiation electrodes 3 or 4 formed in dead spaces or areas where no radiation electrodes 3 and 4 are formed on the top surface 2 of the dielectric substrate 1 to achieve further enhancement of the antenna characteristics.

In FIG. 5A, a periphery 25 of the feeding radiation electrode 3 on the side adjacent to the non-feeding radiation electrode 4 is curved in a direction in which the distance between the periphery 25 and the non-feeding radiation electrode 4 is increased along the direction from the front side surface 7 to the rear side surface 23 until the periphery 25 reaches at the opposite side surface 23 to expand the area of the feeding radiation electrode 3. Thus, the open end 17 of the feeding radiation electrode 3 is formed along substantially the whole length of the right side surface 14 of the dielectric substrate 1. A protrusion 3*b* of the feeding radiation electrode 3 is formed on the right side surface 14 of the dielectric substrate 1 adjacent to the front side surface 7 extending toward the ground surface 16 of the mounting board 15 to locally enhance capacitance coupling between the ground surface 16 and the feeding radiation electrode 3.

In the example of FIG. 5A, the expansion of the electrode area of the feeding radiation electrode 3 increases the volume of the antenna to improve the antenna characteristics of the feeding radiation electrode 3 to that extent. Also, the expansion of the area of the open end 17 of the feeding radiation electrode 3 to include substantially the whole length of the right side surface 14 of the dielectric substrate 1 results in expansion of the area of high intensity electric field, allowing increased gain and enhancement of the antenna characteristics. Furthermore, the periphery 25 of the feeding radiation electrode 3 is formed to curve in the direction that increases the distance between the periphery 25 and the non-feeding radiation electrode 4. In this direction, signal interference between the feeding radiation electrode 3 and the non-feeding radiation electrode 4 tends to be suppressed. This allows improved characteristics due to the effect of interference suppression as well as easier impedance matching adjustment between both of the radiation electrodes 3 and 4, and to prevent deterioration of the antenna characteristics by suppressing interference between the radiation electrodes 3 and 4.

FIG. 5B shows an example in which the electrode area of the non-feeding radiation electrode 4 is expanded in a dead space on the top surface 2 of the dielectric substrate 1: a periphery 25 of the non-feeding radiation electrode 4 on the side adjacent to the feeding radiation electrode 3 is curved in a direction in which the distance between the periphery 25 and the feeding radiation electrode 3 is increased along the direction from the left side surface 19 to the right side surface 14 until the periphery 25 reaches at the opposite side surface 14 to expand the area of the non-feeding radiation electrode 4. Thus, the open end 21 of the non-feeding radiation electrode 4 is formed along the whole length of the rear side surface 23 of the dielectric substrate 1.

In the example of FIG. 5B, the expansion of the electrode area of the non-feeding radiation electrode 4 increases the volume of the antenna to improve the antenna characteristics of the non-feeding radiation electrode 4 to that extent. Also, the expansion of the area of the open end 21 of the non-feeding radiation electrode 4 to include the whole length of the rear side surface 23 of the dielectric substrate 1 results in expansion of the area of high intensity electric field, allowing increased gain as well as enhancement of antenna characteristics. Furthermore, the periphery 25 of the non-feeding radiation electrode 4 is formed to curve in the direction that increases the distance between the periphery 25 and the feeding radiation electrode 3. In this direction, signal interference between the feeding radiation electrode 3 and the non-feeding radiation electrode 4 tends to be suppressed. This allows improved characteristics due to the effect of interference suppression as well as prevents deterioration of the antenna characteristics by suppressing interference between the radiation electrodes.

FIG. 5C shows an example in which the electrode area of the feeding radiation electrode 3 is expanded as is the case of FIG. 5A with similar effects as in the example of FIG. 5A. Also, FIG. 5D shows an example in which the electrode area of the non-feeding radiation electrode 4 is expanded as is the case of FIG. 5B with similar effects as in the example of FIG. 5B.

FIGS. 6A to 6C show modified examples of the dielectric substrate 1 in each of the above embodiments. The embodiments shown in FIGS. 6A to 6C are characterized by formation of a cavity or cavities within the dielectric substrate 1. In the example shown in FIG. 6A two holes 26 having an oval cross section are provided side-by-side with a space between them within the dielectric substrate 1. The example shown in FIG. 6B has a hole 26 with a wider oval cross section within the dielectric substrate 1. Those holes are provided penetrating through the dielectric substrate 1 from the right side surface 14 to the left side surface. The example shown in FIG. 6C has a cavity 27 formed within the dielectric substrate 1 with an opening at the bottom side surface to form a box-like dielectric substrate 1 with an opening at the bottom.

Provision of holes 26 or a cavity 27 enables reducing the weight of the dielectric substrate 1 as well as achieving wider bandwidth and higher gain by reducing effective dielectric constant of the dielectric substrate 1 to mitigate concentration of the electric field between both of the radiation electrodes and the ground electrode. Also, the capacitance coupling is enhanced at the open end of each of the radiation electrodes 3 and 4 to strengthen the intensity of the electric field, allowing enhancement of gain and further improvement of the antenna characteristics.

Figure 7A:
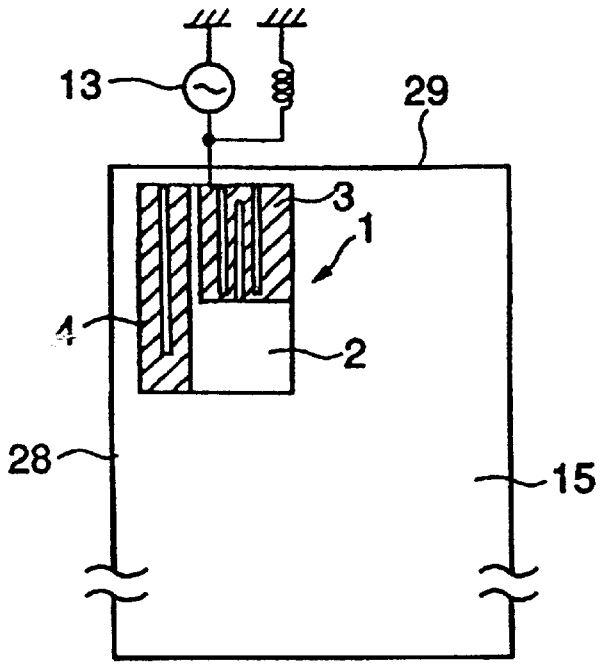
Figure 7C:
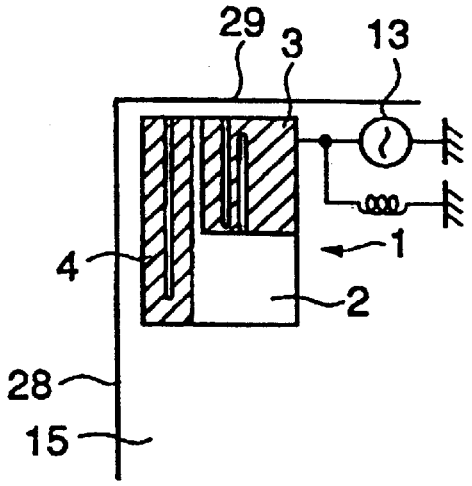
Figure 7B:
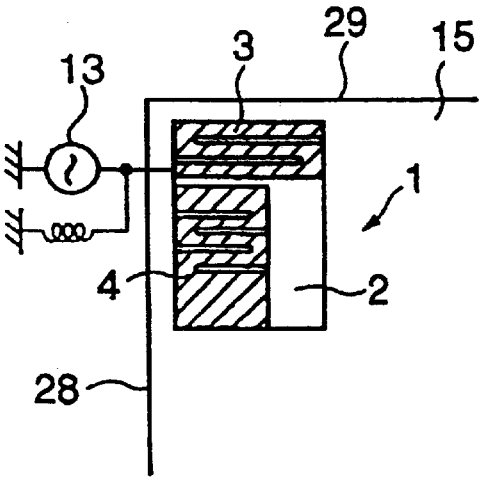
Figure 7D:
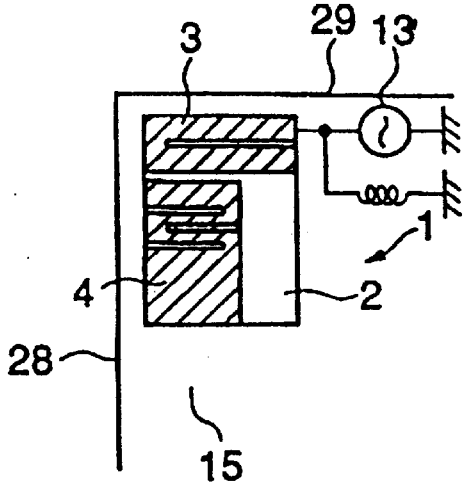

FIGS. 7A to 7D show arrangements for mounting the dielectric substrate 1 on the mounting board 15. FIG. 7A shows an arrangement for mounting the dielectric substrate 1 shown in the first embodiment (FIG. 1), FIG. 7B shows an arrangement for mounting the dielectric substrate 1 shown in the second embodiment (FIG. 2), FIG. 7C shows an arrangement for mounting the dielectric substrate 1 shown in the third embodiment (FIG. 3), and FIG. 7D shows an arrangement for mounting the dielectric substrate 1 shown in the fourth embodiment (FIG. 4). Those arrangements for mounting the dielectric substrate 1 are characterized in that the dielectric substrate 1 is mounted in a corner of a rectangular mounting surface (the ground surface 16) of the mounting board 15 as well as the dielectric substrate 1 is mounted on the mounting board 15 with the non-feeding radiation electrode 4 being disposed along an edge 28 of a longer side of the mounting board 15 and the feeding radiation electrode 3 along an edge 29 of a shorter side of the mounting board 15.

In those embodiments, the dielectric substrate 1 is mounted in a corner of a rectangular mounting surface (the ground surface 16) of the mounting board 15 as well as both of the feeding radiation electrode 3 and the non-feeding radiation electrode 4 are mounted on the mounting board 15 along edges 28 and 29, so that it is possible to prevent the bandwidth from becoming narrower by mitigating the concentration of the electric field due to edge effect of mounting along the edges of the board and, also, it is possible to prevent the deterioration of gain by conducting the image current flowing through the mounting board to the direction of the edges of the mounting board 15.

Also, the arrangement of mounting the non-feeding radiation electrode 4 along the edge 28 of the longer side of the mounting board 15 and the feeding radiation electrode 3 along the edge 29 of the shorter side of the mounting board 15 allows preventing the deterioration of gain of both of the radiation electrodes 3 and 4 as well as balancing the sensitivity of the feeding radiation electrode 3 side with that of the non-feeding radiation electrode 4 side. More specifically, in the antenna operation, the sensitivity will be improved by positioning the radiation electrodes 3 and 4 along the edges of the mounting board 15, where the longer side is more effective in improving sensitivity than the shorter side.

In those embodiments, it is possible to prevent the deterioration of gain of both of the radiation electrodes 3 and 4, since both of the radiation electrodes 3 and 4 are mounted along the edges of the mounting board 15 where sensitivity is improved. Also, compared with the sensitivity of the non-feeding radiation electrode 4, that of the feeding radiation electrode 3 is higher, since the sensitivity of the feeding radiation electrode 3 that is directly (primarily) fed by the signal source 13 is better than that of the non-feeding radiation electrode 4 that is indirectly (secondarily) fed. In this respect, this embodiment allows better antenna operation by balancing the sensitivity of the radiation electrode 3 with that of the radiation electrode 4, since the non-feeding radiation electrode 4 with inferior sensitivity due to secondary excitation is disposed along the edges of the longer side of the mounting board 15 that improves sensitivity and the feeding radiation electrodes 3 with superior sensitivity due to primary excitation is disposed along the edges of the shorter side of the mounting board 15 that reduces sensitivity.

FIG. 8 shows an example of usage (an example of mounting it in a communication apparatus) of an embodiment of the present embodiment. In FIG. 8 the mounting board 15 is provided in a case 31 of the communication apparatus 30 and a feeding circuit 32 is provided on the mounting board 15. On the ground surface (the ground electrode) 16 of the mounting board 15 is mounted, as a surface-mount antenna, the dielectric substrate 1 with electrode patterns of the feeding radiation electrode 3 and the non-feeding radiation electrode 4, etc., formed on it. The feeding radiation electrode 3 is connected to the feeding circuit 32 having the signal source 13 directly or via capacitance coupling. Furthermore, the feeding circuit 32 is connected to the transmitting circuit 34 and the receiving circuit 35 via a switching circuit 33. In this communication apparatus the feeding signal of the signal source 13 of the feeding circuit 32 is supplied to the antenna of the dielectric substrate 1 to perform the above mentioned desired antenna operation and signal transmission and reception is smoothly performed by switching action of the switching circuit 33.

The present invention can take various forms of embodiments without being limited to each of the above embodiments. For example, in each of the above embodiments, the dielectric substrate 1 is made to have a shape of a rectangular parallelepiped (a shape of a rectangular solid with the top surface 2 shaped as an elongated quadrilateral) but it may be a shape of a rectangular solid with the top surface 2 shaped as a square, or, else, may be with the top surface 2 shaped in a polygon (for example, hexagon or octagon, etc.) or a cylindrical body, etc.

In each of the above embodiments, the feeding radiation electrode 3 and a non-feeding radiation electrode 4 are formed in a meandering shape, but there is no need to form them in a meandering shape. However, it is preferable to form the pattern of the radiation electrode in a meandering shape for specifications to perform low-frequency communication, because the meandering shape serves to reduce the frequency used.

As apparent from the above, the present invention provides the following merits:

The present invention provides a configuration in which the feeding radiation electrode and the non-feeding radiation electrode responding to each of two frequencies are adjacently disposed on the surface of the dielectric substrate. Thus, it can satisfactorily meet the demand of downsizing a communication apparatus by achieving substantial downsizing of the antenna device compared to a configuration in which radiation electrodes separately formed for each frequency are disposed side-by-side.

Also, since the short-circuit parts of the feeding radiation electrode and the non-feeding radiation electrode are disposed adjacent to each other on one side of the dielectric substrate so as to be able to form electromagnetic field coupling and the open ends of the feeding radiation electrode and the non-feeding radiation electrode are formed on different surfaces of the dielectric substrate avoiding the surface on which the short-circuit parts are formed, the directions of the resonant currents flowing through each of the feeding radiation electrode and the non-feeding radiation electrode cross each other or are substantially perpendicular or like manner. As a result, the directions of oscillation (or, the directions of polarization) of the signal in the feeding radiation electrode and the signal in the non-feeding radiation electrode cross or are substantially perpendicular, or like manner. This serves to suppress interference between the signals in both of the radiation electrodes, even though the feeding radiation electrode and the non-feeding radiation electrode are disposed adjacent to each other on a surface of a dielectric substrate, allowing stabilized resonant operation responding to each frequency on both of the feeding radiation electrode side and the non-feeding radiation electrode side. Also, mutual signal interference between high intensity electric field portions of the feeding radiation electrode and the non-feeding radiation electrode can be prevented substantially completely, as the open ends of the feeding radiation electrode and the non-feeding radiation electrode are disposed on different sides of the dielectric substrate. Furthermore, due to the above interference suppression effect, even if any one of the radiation electrodes is adjusted, the effect of the adjustment on characteristics of the other radiation electrode would be suppressed, allowing easier matching adjustment between resonant frequency characteristics of both of the feeding radiation electrode and the non-feeding radiation electrode. Thus, it is possible to achieve wider bandwidth and higher gain by suppression of interference between the radiation electrodes.

Furthermore, in addition to the above effect of preventing interference between the signal in the feeding radiation electrode side and that in the non-feeding radiation electrode side, since the open ends of the feeding radiation electrode and the non-feeding radiation electrode, where the intensity of electric fields are highest, are disposed on the different sides of the dielectric substrate, interference between the electric fields on both of the open ends can be suppressed, allowing enhancement of antenna characteristics as well as enhancing gain of the antenna operation in the feeding radiation electrode side and that in the non-feeding radiation electrode side, enabling satisfactory performance as required for communication in spite of downsizing the antenna device.

Furthermore, in the invention in which the dielectric substrate is formed in a shape of a rectangular parallelepiped, either one of the feeding radiation electrode or the non-feeding radiation electrode may be formed along an edge on the top surface of the dielectric substrate over a quadrilateral area that covers substantially the whole length of the edge, while the other electrode is formed within the remaining area of the top surface, the other electrode has an open end covering substantially the whole length of the other edge of the top surface opposed to the area on which the one electrode is formed, the periphery of the one electrode adjacent to the other electrode being curved in a direction in which the distance between the periphery and the other electrode increases along the direction from one side of a width of the quadrilateral area of the one electrode to the other side, the area of the radiation electrode with the curved periphery is expanded to form both of the feeding radiation electrode and the non-feeding radiation electrode on substantially the whole of the top surface of the dielectric substrate.

Even though the area of the radiation electrode with the curved periphery is expanded, the periphery is curved in a direction that increases the distance from the opposing radiation electrode, and signal interference between both of the radiation electrodes is suppressed. This increases the volume of the antenna and allows improved antenna characteristics by that amount.

Furthermore, by forming either one or both of the feeding radiation electrode and the non-feeding radiation electrode in a meandering shape, it is possible to lower the resonant frequency of the radiation electrode formed in a meandering shape, allowing communication using low-frequency signals without difficulty. Also, if the two frequencies used are widely separated, one of the radiation electrodes may be set for a higher frequency by being formed without a meandering shape and the other radiation electrode may be set for a lower frequency by being formed in a meandering shape, so as to obtain such an effect as enabling disposing a radiation electrode oscillating at a higher frequency and a radiation electrode oscillating at a lower frequency on a surface of a single dielectric substrate without difficulty.

Furthermore, in configurations in which a cavity or cavities are provided inside of the dielectric substrate by providing a hole or holes or providing an opening on the bottom, it is possible to produce a light-weight antenna device as well as to achieve reduction of effective dielectric constant of the dielectric substrate, mitigating concentration of the electric field between both of the radiation electrodes and the ground electrode to allow increased bandwidth and gain. Also, due to reduction of effective dielectric constant of the dielectric substrate, the electric fields on the radiation electrodes formed on the top surface of the dielectric substrate are weakened by a dispersion effect, while, conversely, the capacitance coupling (the capacitance coupling with the ground surface) is enhanced at the open ends of the radiation electrodes to strengthen the intensity of the electric fields, allowing further enhancement of the antenna characteristics.

In the embodiments in which the dielectric substrate on which the feeding radiation electrode and the non-feeding radiation electrode are formed is mounted in a corner of a mounting board, it is possible to enhance the gain of the antenna operation (to prevent the deterioration of gain). Also, by mounting the non-feeding radiation electrode along the longer edge of the mounting board with elongated quadrilateral-shape where the sensitivity is maximum, it is possible to enhance the relative sensitivity of the secondarily-fed non-feeding radiation electrode that has lower sensitivity than the primarily-fed feeding radiation electrode. This allows balancing the sensitivity of the feeding radiation electrode with that of the non-feeding radiation electrode, enabling better antenna operation.

Furthermore, the communication apparatus of the present invention allows downsizing the communication apparatus as well as reducing the assembling costs thereof by mounting such a compact surface-mount antenna (antenna device) on the communication apparatus.

While the invention has been particularly shown and described with reference to preferred embodiments thereof, it will be understood by those skilled in the art that the foregoing and other changes in form and details may be made therein without departing from the spirit of the invention.

What is claimed is:

1. An antenna device comprising:

a feeding radiation electrode and a non-feeding radiation electrode separately disposed on a surface of a dielectric substrate;

a short circuit part of the feeding radiation electrode and a short circuit part of the non-feeding radiation electrode adjacently disposed to each other on one side surface of the dielectric substrate; and an open end of the feeding radiation electrode and an open end of the non-feeding radiation electrode disposed on mutually different surface sides of the dielectric substrate other than the surface on which said short circuit parts are disposed.

2. The antenna device of claim 1, wherein the open end of the feeding radiation electrode and the open end of the non-feeding radiation electrode are disposed on mutually opposing surface sides of the dielectric substrate.

3. The antenna device of claim 2, wherein the feeding radiation electrode and the non-feeding radiation electrode are disposed so as to cause a direction of oscillation of the feeding radiation electrode and a direction of oscillation of the non-feeding radiation electrode to cross each other in substantially perpendicular directions.

4. The antenna device of claim 2, wherein the dielectric substrate is in a shape of a rectangular parallelepiped, one of the feeding radiation electrode and the non-feeding radiation electrode being disposed along an edge on the top surface of the dielectric substrate over a quadrilateral area that covers substantially the whole length of the edge, a second of the two electrodes being disposed within the remaining area of the top surface, the second electrode having an open end covering substantially the whole length of another edge of the top surface opposed to the area on which said first electrode is disposed, a periphery of the first electrode adjacent to said second electrode being curved in a direction in which a distance between the periphery and said second electrode increases along the direction from one side of a width of the quadrilateral area of said first electrode to the other side.

5. The antenna device of claim 2, wherein at least one of the feeding radiation electrode and the non-feeding radiation electrode is formed in a meandering shape.

6. The antenna device of claim 2, wherein the dielectric substrate has at least one cavity therein.

7. The antenna device of claim 2, wherein the dielectric substrate on which the feeding radiation electrode and the non-feeding radiation electrode are disposed is mounted on a corner portion of a mounting board having a quadrilateral shape and said feeding radiation electrode and said non-feeding radiation electrode disposed on the dielectric substrate are disposed along an edge portion of the mounting board.

8. The antenna device of claim 1, wherein the feeding radiation electrode and the non-feeding radiation electrode are disposed so as to cause a direction of oscillation of the feeding radiation electrode and a direction of oscillation of the non-feeding radiation electrode to cross each other in substantially perpendicular directions.

9. The antenna device of claim 8, wherein the dielectric substrate is in a shape of a rectangular parallelepiped, one of the feeding radiation electrode and the non-feeding radiation electrode being disposed along an edge on the top surface of the dielectric substrate over a quadrilateral area that covers substantially the whole length of the edge, a second of the two electrodes being disposed within the remaining area of the top surface, the second electrode having an open end covering substantially the whole length of another edge of the top surface opposed to the area on which said first electrode is disposed, a periphery of the first electrode adjacent to said second electrode being curved in a direction in which a distance between the periphery and said second electrode increases along the direction from one side of a width of the quadrilateral area of said first electrode to the other side.

10. The antenna device of claim 8, wherein at least one of the feeding radiation electrode and the non-feeding radiation electrode is formed in a meandering shape.

11. The antenna device of claim 8, wherein the dielectric substrate has at least one cavity therein.

12. The antenna device of claim 8, wherein the dielectric substrate on which the feeding radiation electrode and the non-feeding radiation electrode are disposed is mounted on a corner portion of a mounting board having a quadrilateral shape and said feeding radiation electrode and said non-feeding radiation electrode disposed on the dielectric substrate are disposed along an edge portion of the mounting board.

13. The antenna device of claim 1, wherein the dielectric substrate is in a shape of a rectangular parallelepiped, one of the feeding radiation electrode and the non-feeding radiation electrode being disposed along an edge on the top surface of the dielectric substrate over a quadrilateral area that covers substantially the whole length of the edge, a second of the two electrodes being disposed within the remaining area of the top surface, the second electrode having an open end covering substantially the whole length of another edge of the top surface opposed to the area on which said first electrode is disposed, a periphery of the first electrode adjacent to said second electrode being curved in a direction in which a distance between the periphery and said second electrode increases along the direction from one side of a width of the quadrilateral area of said first electrode to the other side.

14. The antenna device of claim 13, wherein at least one of the feeding radiation electrode and the non-feeding radiation electrode is formed in a meandering shape.

15. The antenna device of claim 13, wherein the dielectric substrate has at least one cavity therein.

16. The antenna device of claim 13, wherein the dielectric substrate on which the feeding radiation electrode and the non-feeding radiation electrode are disposed is mounted on a corner portion of a mounting board having a quadrilateral shape and said feeding radiation electrode and said non-feeding radiation electrode disposed on the dielectric substrate are disposed along an edge portion of the mounting board.

17. The antenna device of claim 1, wherein at least one of the feeding radiation electrode and the non-feeding radiation electrode is formed in a meandering shape.

18. The antenna device of claim 17, wherein the dielectric substrate has at least one cavity therein.

19. The antenna device of claim 17, wherein the dielectric substrate on which the feeding radiation electrode and the non-feeding radiation electrode are disposed is mounted on a corner portion of a mounting board having a quadrilateral shape and said feeding radiation electrode and said non-feeding radiation electrode disposed on the dielectric substrate are disposed along an edge portion of the mounting board.

20. The antenna device of claim 1, wherein dielectric substrate has at least one cavity therein.

21. The antenna device of claim 20, wherein the dielectric substrate on which the feeding radiation electrode and the non-feeding radiation electrode are disposed is mounted on a corner portion of a mounting board having a quadrilateral shape and said feeding radiation electrode and said non-feeding radiation electrode disposed on the dielectric substrate are disposed along an edge portion of the mounting board.

22. The antenna device of claim 1, wherein the dielectric substrate on which the feeding radiation electrode and the non-feeding radiation electrode are disposed is mounted on a corner portion of a mounting board having a quadrilateral shape and said feeding radiation electrode and said non-feeding radiation electrode disposed on the dielectric substrate are disposed along an edge portion of the mounting board.

23. The antenna device of claim 22, wherein the mounting board has an elongated quadrilateral-shape and the non-feeding radiation electrode is disposed along an edge of a longer side of the mounting board.

24. A communication apparatus having an antenna device comprising:

a feeding radiation electrode and a non-feeding radiation electrode separately disposed on a surface of a dielectric substrate;

a short circuit part of the feeding radiation electrode and a short circuit part of the non-feeding radiation electrode adjacently disposed to each other on one side surface of the dielectric substrate; and an open end of the feeding radiation electrode and an open end of the non-feeding radiation electrode disposed on mutually different surface sides of the dielectric substrate other than the surface on which said short circuit parts are disposed.

25. The communication apparatus of claim 24 wherein the open end of the feeding radiation electrode and the open end of the non-feeding radiation electrode are disposed on mutually opposing surface sides of the dielectric substrate.

26. The communication apparatus of claim 24, wherein the feeding radiation electrode and the non-feeding radiation electrode are disposed so as to cause a direction of oscillation of the feeding radiation electrode and a direction of oscillation of the non-feeding radiation electrode to cross each other in substantially perpendicular directions.

27. The communication apparatus of claim 24, wherein the dielectric substrate is in a shape of a rectangular parallelepiped, one of the feeding radiation electrode and the non-feeding radiation electrode being disposed along an edge on the top surface of the dielectric substrate over a quadrilateral area that covers substantially the whole length of the edge, a second of the two electrodes being disposed within the remaining area of the top surface, the second electrode having an open end covering substantially the whole length of another edge of the top surface opposed to the area on which said first electrode is disposed, a periphery of the first electrode adjacent to said second electrode being curved in a direction in which a distance between the periphery and said second electrode increases along the direction from one side of a width of the quadrilateral area of said first electrode to the other side.

28. The communication apparatus of claim 24, wherein at least one of the feeding radiation electrode and the non-feeding radiation electrode is formed in a meandering shape.

29. The communication apparatus of claim 24, wherein the dielectric substrate has at least one cavity therein.

30. The communication apparatus of claim 24, wherein the dielectric substrate on which the feeding radiation electrode and the non-feeding radiation electrode are disposed is mounted on a corner portion of a mounting board having a quadrilateral shape and said feeding radiation electrode and said non-feeding radiation electrode disposed on the dielectric substrate are disposed along an edge portion of the mounting board.

31. The communication apparatus of claim 30, wherein the mounting board has an elongated quadrilateral-shape and the non-feeding radiation electrode is disposed along an edge of a longer side of the mounting board.

* * * * *